US010786721B2

(12) United States Patent
He

(10) Patent No.: US 10,786,721 B2
(45) Date of Patent: Sep. 29, 2020

(54) ACTIVE WOODEN DUMMY

(71) Applicant: Xiaohui He, Fujian (CN)

(72) Inventor: Xiaohui He, Fujian (CN)

( * ) Notice: Subject to any disclaimer, the term of this patent is extended or adjusted under 35 U.S.C. 154(b) by 29 days.

(21) Appl. No.: 16/335,244

(22) PCT Filed: Aug. 1, 2017

(86) PCT No.: PCT/CN2017/095413
§ 371 (c)(1),
(2) Date: Mar. 20, 2019

(87) PCT Pub. No.: WO2018/068560
PCT Pub. Date: Apr. 19, 2018

(65) Prior Publication Data

US 2019/0255411 A1 Aug. 22, 2019

(30) Foreign Application Priority Data

Oct. 13, 2016 (CN) ..... 2016 2 1119002 U

(51) Int. Cl.
*A63B 69/34* (2006.01)
*A63B 71/06* (2006.01)

(52) U.S. Cl.
CPC ..... *A63B 69/34* (2013.01); *A63B 71/06* (2013.01); *A63B 71/0622* (2013.01); *A63B 2071/0658* (2013.01); *A63B 2220/56* (2013.01); *A63B 2220/833* (2013.01); *A63B 2244/10* (2013.01)

(58) Field of Classification Search
CPC ..... A63B 69/004; A63B 69/34; A63B 71/06; A63B 71/0622; A63B 2071/025; A63B 2071/0658; A63B 2209/00; A63B 2220/53; A63B 2220/56; A63B 2220/833; A63B 2244/10
See application file for complete search history.

(56) References Cited

U.S. PATENT DOCUMENTS 3,250,533 A * 5/1966 Nicholson ..... A63B 69/34 482/83
4,088,315 A * 5/1978 Schemmel ..... G06F 19/3481 482/4
4,765,609 A * 8/1988 Wilson ..... A63B 69/34 482/83
4,819,934 A * 4/1989 Wilson ..... A63B 69/34 482/83

(Continued)

*Primary Examiner* — Joshua Lee

(57) ABSTRACT

The invention relates to the field of Wushu facilities and provides a novel active wooden dummy comprising a lower limb assembly, an upper body assembly and two arm assemblies. The lower limb assembly is provided with a driving device and a vertical spindle. The spindle is vertically arranged. The upper body assembly is rotatably arranged on the spindle. The driving device drives the upper body assembly to repeatedly swing leftwards or rightwards. Each arm assembly comprises a front arm rod, a rear arm rod, a turning rod and a connection rod. Kinetic energy generated when the upper body assembly swings is used to drive the arm assemblies to stretch or retreat, the whole wooden dummy can be driven by one driving device to move, and the arm assemblies stretch or retreat when the upper body assembly swings, so as to simulate attack motions from opponents in actual combat.

3 Claims, 4 Drawing Sheets

(56) References Cited

U.S. PATENT DOCUMENTS

| | | | | | |
|---|---|---|---|---|---|
| 5,052,683 | A * | 10/1991 | Wang | A63B 69/34 | 273/458 |
| 5,700,230 | A * | 12/1997 | Cardona | A63B 69/34 | 482/83 |
| 6,110,079 | A * | 8/2000 | Luedke | A63B 24/0062 | 446/268 |
| 7,828,701 | B1 * | 11/2010 | Chen | A63B 69/004 | 482/83 |
| 7,857,729 | B2 * | 12/2010 | Sullivan | A63B 69/004 | 482/1 |
| 8,025,612 | B1 * | 9/2011 | Buzzanco | A63B 21/0087 | 482/83 |
| 8,777,818 | B1 * | 7/2014 | Tate, Jr. | A63B 69/004 | 482/83 |
| 2004/0248633 | A1 * | 12/2004 | Trawick | A63B 69/34 | 463/8 |
| 2011/0256990 | A1 * | 10/2011 | Machado | A63B 69/345 | 482/83 |
| 2014/0213418 | A1 * | 7/2014 | Lewicki | A63B 69/34 | 482/12 |
| 2014/0378281 | A1 * | 12/2014 | Mazi | B25J 11/003 | 482/83 |
| 2015/0265898 | A1 * | 9/2015 | Hall | A63B 24/00 | 482/83 |
| 2016/0082336 | A1 * | 3/2016 | Scionti | A63B 69/34 | 473/454 |
| 2016/0101338 | A1 * | 4/2016 | Daniels | A63B 24/0003 | 482/8 |
| 2016/0220882 | A1 * | 8/2016 | Milligan | G09B 9/003 | |

* cited by examiner

ACTIVE WOODEN DUMMY

TECHNICAL FIELD

The invention relates to the field of Wushu facilities, in particular to novel active wooden dummy.

DESCRIPTION OF RELATED ART

Wooden dummies are indispensible instruments used for single training. Most existing wooden dummies have three arms and one leg and are stationary. However, such wooden dummies can only be used for boxing training and cannot simulate attack and defense motions in actual combat.

BRIEF SUMMARY OF THE INVENTION

The objective of the invention is to overcome the above defects by providing a novel active wooden dummy capable of better simulating actual combat.

The technical solution adopted by the invention to fulfill the above objective is as follows:

A novel active wooden dummy comprises a lower limb assembly, an upper body assembly and two arm assemblies. The lower limb assembly is provided with a driving device and a spindle. The spindle is vertically arranged. The upper body assembly is rotatably arranged on the spindle. The driving device drives the upper body assembly to repeatedly swing leftwards or rightwards. Each arm assembly comprises a front arm rod, a rear arm rod, a turning rod and a connection rod. Two connection ends extending towards two sides to be rotatably connected with the connection rods are formed on the spindle. The middle of each turning rod is rotatably fixed to the upper body assembly. Each turning rod has an end rotatably connected with the corresponding connection rod and an end rotatably connected with an end of the corresponding front arm rod. Each rear arm rod has an end rotatably connected with an outer wall of the upper body assembly and an end rotatably connected with a back side of the corresponding front arm rod.

Furthermore, each turning rod comprises an inner rod, a rotary shaft and an outer rod which are perpendicularly connected in sequence. The inner rods and the outer rods are separately arranged on an inner side and an outer side of the upper body assembly and extend in opposite directions. The rotary shafts are rotatably arranged in through holes formed in a left side and a right side of the upper body assembly.

Furthermore, the novel active wooden dummy further comprises pressure sensors and displays, and the pressure sensors are located on a surface of the upper body assembly and are electrically connected with the displays.

Furthermore, the displays are arranged on the eyes of a head of the upper body assembly.

Furthermore, the driving device comprises a motor, a rotary table and a link rod. The rotary table is rotatably and horizontally arranged on the lower limb assembly. The motor is arranged on the lower limb assembly and drives the rotary table to rotate. One end of the link rod is rotatably arranged on an edge of an upper surface of the rotary table.

The invention has the following beneficial effects: The structure is simple; kinetic energy generated when the upper body assembly swings is used to drive the arm assemblies to stretch or retreat, the whole wooden dummy can be driven by one driving device to move, and the arm assemblies stretch or retreat when the upper body assembly swings, so as to simulate attack motions from opponents in actual combat; and when used for single training, the novel active wooden dummy can simulate defense motions, dodging motions, counterattack motions and the like, thereby fulfilling a good training effect and being highly targeted.

REFERENCE SIGNS

1, lower limb assembly; 2, upper body assembly; 3, arm assembly; 4, pressure sensor; 5, display; 11, driving device; 12, spindle; 111, motor; 112, rotary table; 113, link rod; 31, front arm rod; 32, rear arm rod; 33, turning rod; 34, connection rod; 331, inner rod; 332, rotary shaft; 333, outer rod.

DETAILED DESCRIPTION OF THE INVENTION

The technical contents, structural features, objectives and effects of the invention are detailed below with reference to an embodiment and the accompanying drawings.

The key conception of the invention is that kinetic energy generated when an upper body assembly swings is used to drive arm assemblies to stretch or retreat to simulate attack motions from opponents in actual combat, thus fulfilling a good training effect and being highly targeted.

Figure 1:
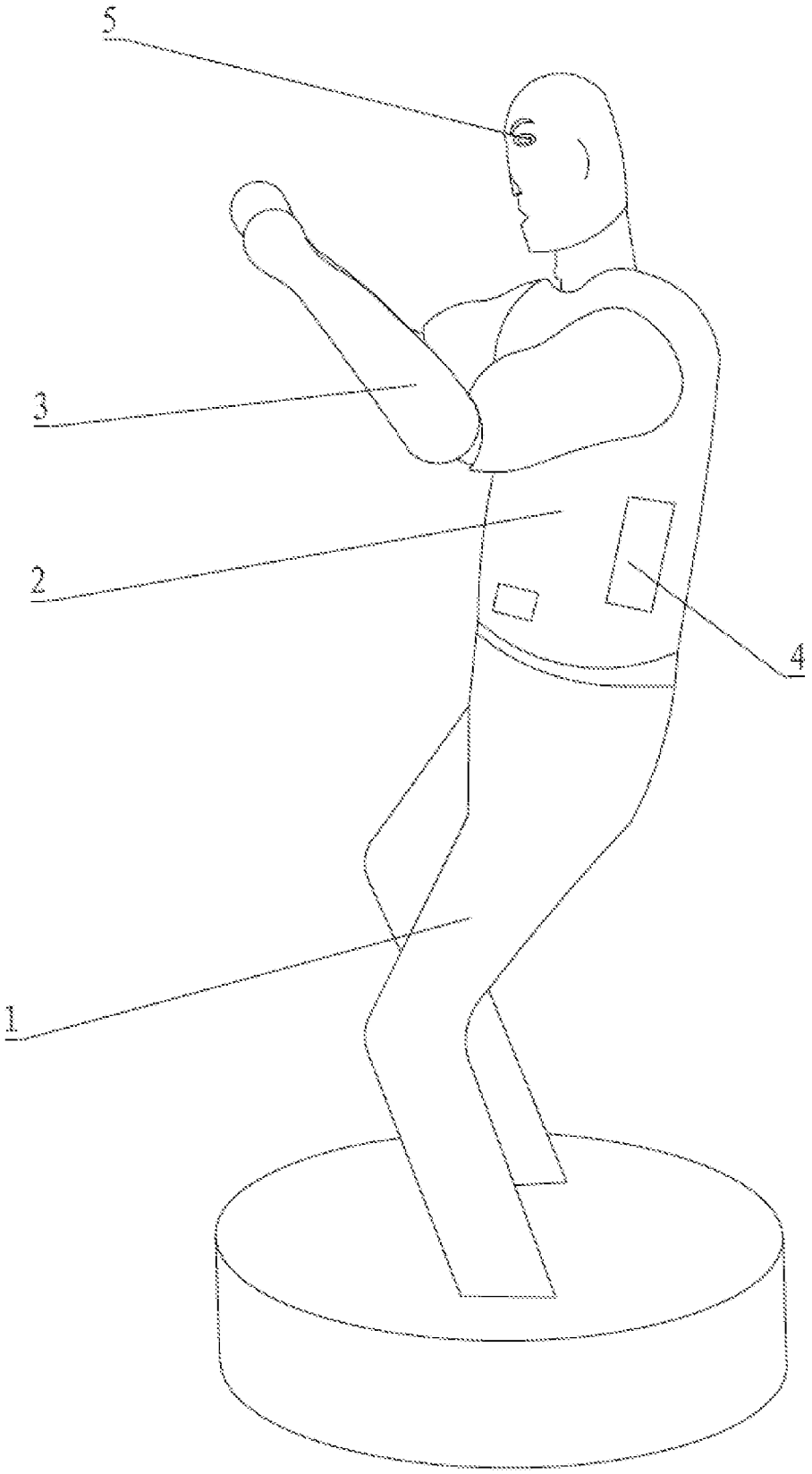
FIG. 1 is a perspective view of a novel active wooden dummy in an embodiment of the invention.
Figure 2:
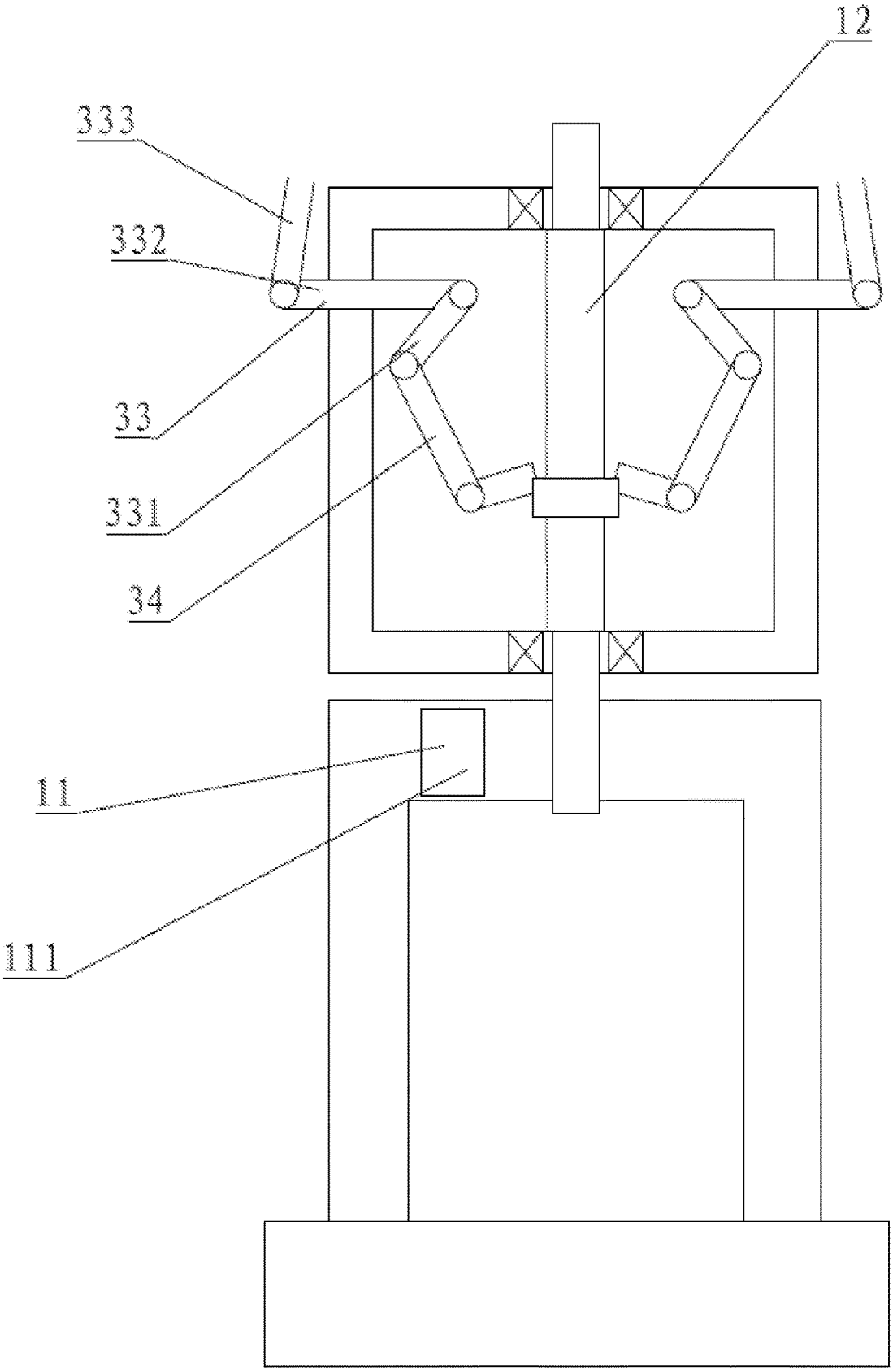
FIG. 2 is a front mechanical principle view of the novel active wooden dummy in the embodiment of the invention.
Figure 3:
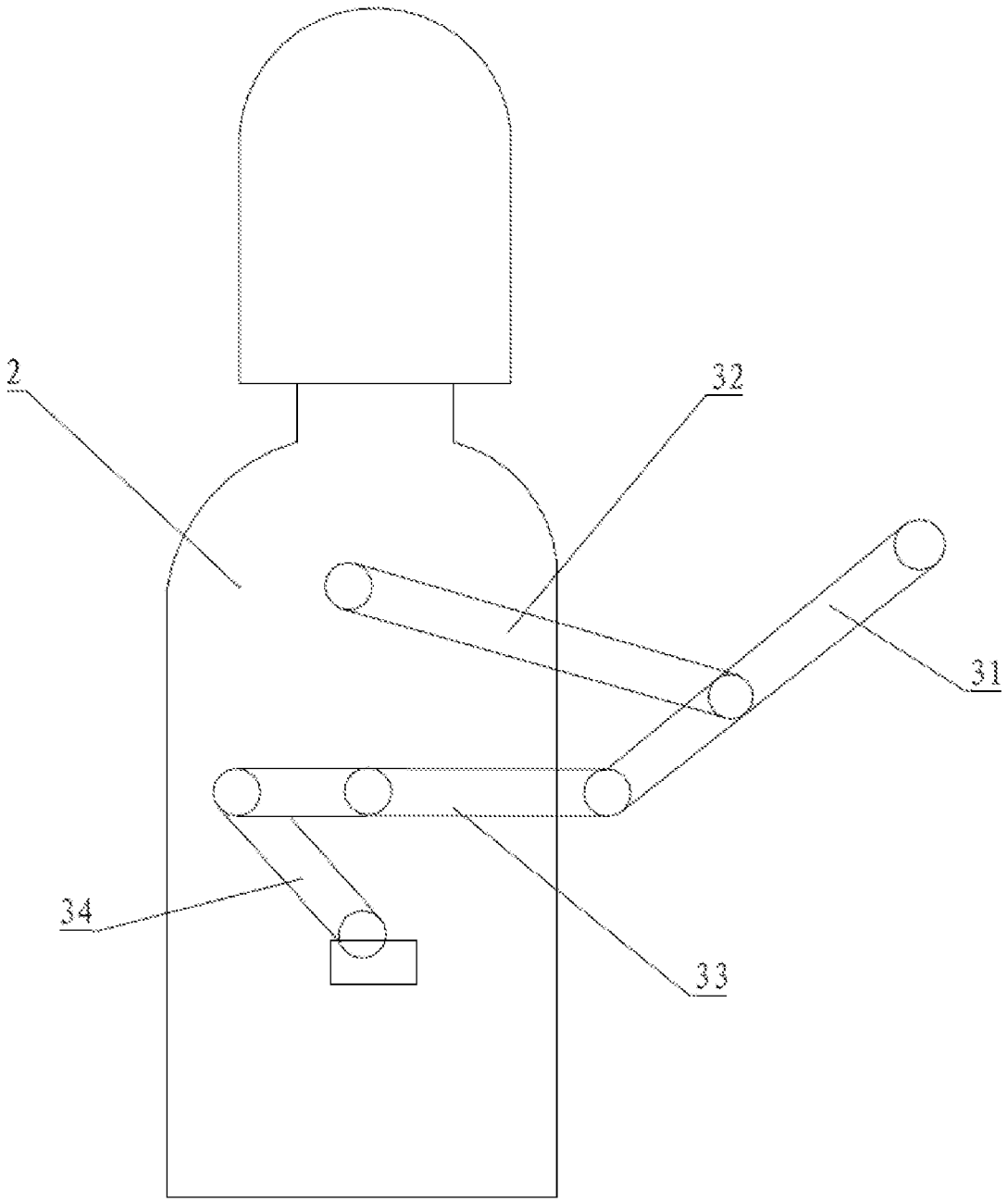
FIG. 3 is a side mechanical principle view of the novel active wooden dummy in the embodiment of the invention.
Figure 4:
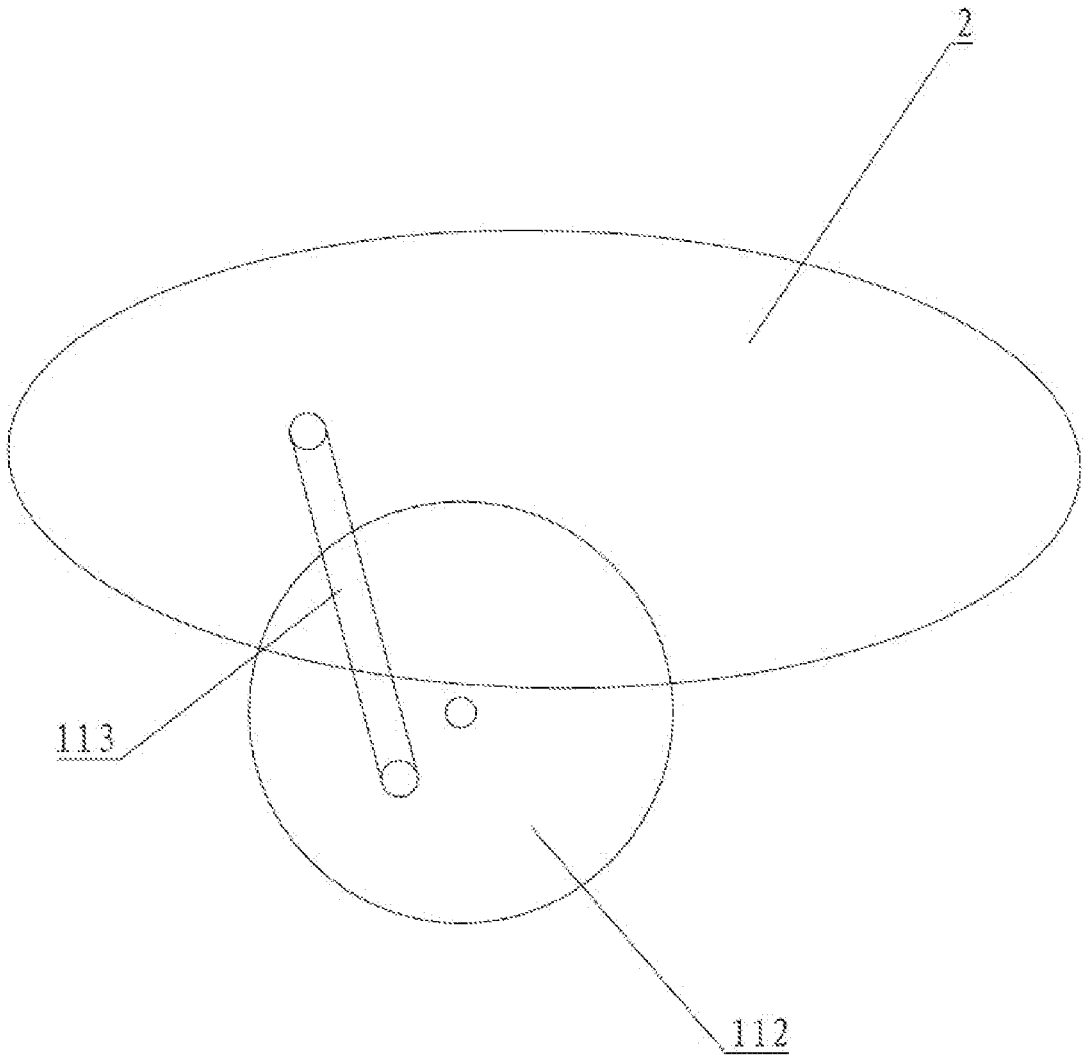
FIG. 4 is a structural view of a driving device of the novel active wooden dummy in the embodiment of the invention.

Referring to FIGS. 1-4, a novel active wooden dummy comprises a lower limb assembly 1, an upper body assembly 2 and two arm assemblies 3. The lower limb assembly 1 is provided with a driving device 11 and a spindle 12. The spindle 12 is vertically arranged. The upper body assembly 2 is rotatably arranged on the spindle 12. The driving device 11 drives the upper body assembly 2 to repeatedly swing leftwards or rightwards. Each arm assembly 3 comprises a front arm rod 31, a rear arm rod 32, a turning rod 33 and a connection rod 34. Two connection ends extending towards two sides to be rotatably connected with ends of the connection rods 34 are formed on the spindle 12. The middle of each turning rod 33 is rotatably fixed to the upper body assembly 2. Each turning rod 33 has an end rotatably connected with the corresponding connection rod 34 and an end rotatably connected with an end of the corresponding front arm rod. Each rear arm rod 32 has an end rotatably connected with an outer wall of the upper body assembly 2 and an end rotatably connected with a back side of the corresponding front arm rod 31.

The working process of the novel active wooden dummy is as follows: the driving device 11 drives the upper body assembly 2 to repeatedly swing leftwards or rightwards; as the spindle 12 is stationary, the arm assemblies 3 swing along with the upper body assembly 2; the distance between the turning rods 33 and the connection ends varies all the time when the arm assemblies 3 swing, so that every time the arm assemblies 3 swing, the connection rods 34 pull the turning rods 33 downwards, the other ends of the turning rods 33 are lifted to push the front arm rods to stretch forwards to simulate punching motions; and then, the upper body assembly 2 continues to swing, and the front arm rods retreat under the effect of self weights and rotation of the turning rods 33 when the pulling force of the connection rods 34 disappears.

Furthermore, the upper body assembly 2 is provided with a head and a neck. A tension spring is arranged in a joint of the head and the neck. When impacted, the head swings in the impact direction. The head can swing in any directions.

Furthermore, four sliding wheels are arranged at the bottom of the lower limb assembly 1 so that the lower limb assembly 1 can horizontally slide on the ground. A left side and a right side of the bottom of the lower limb assembly 1 are connected with the ground through tension springs. When impacted, the upper body assembly 2 and the lower limb assembly 1 retreat; and when an impact force disappears, the upper body assembly 2 and the lower limb assembly 1 return to original positions.

Therefore, the invention has the following beneficial effects: the structure is simple; kinetic energy generated when the upper body assembly 2 swings is used to drive the arm assemblies 3 to stretch or retreat, the whole wooden dummy can be driven by one driving device 11 to move, and the arm assemblies 3 stretch or retreat when the upper body assembly swings, so as to simulate attack motions from opponents in actual combat; and when used for single training, the novel active wooden dummy can simulate defense motions, dodging motions, counterattack motions and the like, thereby fulfilling a good training effect and being highly targeted.

Furthermore, each turning rod 33 comprises an inner rod 331, a rotary shaft 332 and an outer rod 333 which are perpendicularly connected in sequence. The inner rods 331 and the outer rods 333 are separately arranged on an inner side and an outer side of the upper body assembly 2 and extend in opposite directions. The rotary shafts 332 are rotatably mounted in through holes formed in a left side and a right side of the upper body assembly 2.

Therefore, the turning rods 33 of this special structure can be firmly fixed to the upper body assembly 2 and can transmit rotation power out of the upper body assembly 2 from the interior of the upper body assembly 2.

Furthermore, the novel active wooden dummy further comprises pressure sensors 4 and displays 5, wherein the pressure sensors 4 are located on a surface of the upper body assembly 2 and are electrically connected with the displays 5.

Therefore, when trainees attack the upper body assembly 2, the pressure sensors 4 sense the attack force, and force values are displayed on the displays 5 for reference by the trainees.

Furthermore, the displays 5 are arranged on the eyes of the head of the upper body assembly 2.

Because the displays 5 are arranged on the eyes of the head of the upper body assembly 2, sights of the opponents can be accurately observed in actual combat, and the training condition is more similar to actual combat.

Furthermore, the driving device 11 comprises a motor 111, a rotary table 112 and a link rod 113, wherein the rotary table 112 is rotatably and horizontally arranged on the lower limb assembly 1, the motor 111 is arranged on the lower limb assembly 1 and drives the rotary table 112 to rotate, and one end of the link rod 113 is rotatably arranged on an edge of an upper surface of the rotary table 112.

Therefore, every time the rotary table 112 rotates, the upper body assembly 2 is pulled or pushed to repeatedly swing leftwards or rightwards.

Please refer to FIGS. 1-4 for the first embodiment of the invention:

A novel active wooden dummy comprises a lower limb assembly 1, an upper body assembly 2 and two arm assemblies 3. The lower limb assembly 1 is provided with a driving device 11 and a spindle 12. The spindle 12 is vertically arranged. The upper body assembly 2 is rotatably arranged on the spindle 12. The driving device 11 drives the upper body assembly 2 to repeatedly swing leftwards or rightwards. Each arm assembly 3 comprises a front arm rod 31, a rear arm rod 32, a turning rod 33 and a connection rod 34. Two connection ends extending towards two sides to be rotatably connected with ends of the connection rods 34 are formed on the spindle 12. The middle of each turning rod 33 is rotatably fixed to the upper body assembly 2. Each turning rod 33 has an end rotatably connected with the corresponding connection rod 34 and an end rotatably connected with an end of the corresponding front arm rod. Each rear arm rod 32 has an end rotatably connected with an outer wall of the upper body assembly 2 and an end rotatably connected with a back side of the corresponding front arm rod 31. Each turning rod 33 comprises an inner rod 331, a rotary shaft 332 and an outer rod 333 which are perpendicularly connected in sequence. The inner rods 331 and the outer rods 333 are separately arranged on an inner side and an outer side of the upper body assembly 2 and extend in opposite directions. The rotary shafts 332 are rotatably arranged in through holes formed in a left side and a right side of the upper body assembly 2. The novel active wooden dummy further comprises sensors 4 and displays 5. The pressure sensors 4 are located on a surface of the upper body assembly 2 and are electrically connected with the displays 5. The displays 5 are arranged on the eyes of a head of the upper body assembly 2. The driving device 11 comprises a motor 111, a rotary table 112 and a link rod 113. The rotary table 112 is rotatably and horizontally arranged on the lower limb assembly 1. The motor 111 is arranged on the lower limb assembly 1 and drives the rotary table 112 to rotate. One end of the link rod 113 is rotatably arranged on an edge of an upper surface of the rotary table 112.

The novel active wooden dummy is simple in structure; kinetic energy generated when the upper body assembly swings is used to drive the arm assemblies to stretch or retreat, the whole wooden dummy can be driven by one driving device to move, and the arm assemblies stretch or retreat when the upper body assembly swings, so as to simulate attack motions from opponents in actual combat; and when used for single training, the novel active wooden dummy can simulate defense motions, dodging motions, counterattack motions and the like, thereby fulfilling a good training effect and being highly targeted. The turning rods of the special structure can be firmly fixed to the upper body assembly and can transmit rotation power out of the upper body assembly from the interior of the upper body assembly. When trainees attack the upper body assembly, the pressure sensors sense the attack force, and force values are displayed on the displays for reference by the trainees. The displays are arranged on the eyes of the head of the upper body assembly so that sights of the opponents can be accurately observed in actual combat, and the training condition is more similar to actual combat. Every time the rotary table rotates, the upper body assembly is pulled or pushed to repeatedly swing leftwards or rightwards.

The above embodiment is only an illustrative one of the invention and is not intended to limit the patent scope of the invention.

All equivalent structures or equivalent process transformations obtained based on the specification and accompanying drawings, or direct or indirect applications to other relevant technical fields should also fall within the patent protection scope of the invention.

What is claimed is:

1. A novel active wooden dummy, comprising a lower limb assembly, an upper body assembly and two arm assemblies, wherein the lower limb assembly is provided with a driving device and a spindle, the spindle is vertically arranged, the upper body assembly is rotatably arranged on the spindle, the driving device drives the upper body assembly to repeatedly swing leftwards or rightwards, each said arm assembly comprises a front arm rod, a rear arm rod, a turning rod and a connection rod, two connection ends extending towards two sides to be rotatably connected with ends of the connection rods are formed on the spindle, a middle of each said turning rod is rotatably fixed to the upper body assembly, each said turning rod has an end rotatably connected with the corresponding connection rod and an end rotatably connected with an end of the corresponding front arm rod, and each said rear arm rod has an end rotatably connected with an outer wall of the upper body assembly and an end rotatably connected with a back side of the corresponding front arm rod;

wherein each said turning rod comprises an inner rod, a rotary shaft and an outer rod which are perpendicularly connected in sequence, the inner rods and the outer rods are separately arranged on an inner side and an outer side of the upper body assembly and extend in opposite directions, and the rotary shafts are rotatably arranged in through holes formed in a left side and a right side of the upper body assembly.

2. The novel active wooden dummy according to claim 1, wherein the driving device comprises a motor, a rotary table and a link rod, the rotary table is rotatably and horizontally arranged on the lower limb assembly, the motor is arranged on the lower limb assembly and drives the rotary table to rotate, and one end of the link rod is rotatably arranged on an edge of an upper surface of the rotary table.

3. A novel active wooden dummy, comprising a lower limb assembly, an upper body assembly and two arm assemblies, wherein the lower limb assembly is provided with a driving device and a spindle, the spindle is vertically arranged, the upper body assembly is rotatably arranged on the spindle, the driving device drives the upper body assembly to repeatedly swing leftwards or rightwards, each said arm assembly comprises a front arm rod, a rear arm rod, a turning rod and a connection rod, two connection ends extending towards two sides to be rotatably connected with ends of the connection rods are formed on the spindle, a middle of each said turning rod is rotatably fixed to the upper body assembly, each said turning rod has an end rotatably connected with the corresponding connection rod and an end rotatably connected with an end of the corresponding front arm rod, and each said rear arm rod has an end rotatably connected with an outer wall of the upper body assembly and an end rotatably connected with a back side of the corresponding front arm rod; wherein the novel active wooden dummy further comprises pressure sensors and displays, the pressure sensors are located on a surface of the upper body assembly and are electrically connected with the displays, wherein the displays are arranged on the eyes of a head of the upper body assembly.

* * * * *